US006024293A

United States Patent [19]

Hall

[11] Patent Number: 6,024,293

[45] Date of Patent: Feb. 15, 2000

[54] NON-MAGNETIC SHELL FOR WELDED FUEL INJECTOR

[75] Inventor: Bryan C. Hall, Newport News, Va.

[73] Assignee: Siemens Automotive Corporation, Newport News, Va.

[21] Appl. No.: 09/327,395

[22] Filed: Jun. 7, 1999

Related U.S. Application Data

[62] Division of application No. 09/019,096, Feb. 5, 1998.

[51] Int. Cl.[7] ..... F02D 1/06

[52] U.S. Cl. ..... 239/5; 239/1; 239/585.1; 239/585.4; 29/606; 29/602.1

[58] Field of Search ..... 239/1, 5, 533.1, 239/583, 584, 585.1–585.5; 251/129.21; 29/602.1, 606

[56] References Cited

U.S. PATENT DOCUMENTS 5,040,731 8/1991 Yokoyama et al. ..... 239/585
5,427,319 6/1995 Bata ..... 239/585.4
5,465,910 11/1995 Hall et al. ..... 239/585.4
5,625,946 5/1997 Wildeson et al. ..... 29/888.41

*Primary Examiner*—Andres Kashnikow
*Assistant Examiner*—Jorge S. Bocanegra

[57] ABSTRACT

A solenoid actuated fuel injector includes an elongated ferromagnetic inlet tube having a major outside diameter portion and a reduced outside diameter portion and a step between the major and reduced outside diameter portions. A two-ended non-magnetic shell including an elongated tubular portion and a valve body shell engaging portion is fittable over the inlet tube reduced diameter portion and abuts the step in the inlet tube at one end. A coil is mountable around the elongated tubular portion of the non-magnetic shell and seated on the valve body shell engaging portion. The coil has a length shorter than the elongated tubular portion, at at least one circumferential point of the coil, allowing the inlet tube to be welded to the non-magnetic shell upon rotation relative to the coil without having to move the coil longitudinally.

3 Claims, 4 Drawing Sheets

NON-MAGNETIC SHELL FOR WELDED FUEL INJECTOR

This is a divisional of application Ser. No. 09/019,096, filed Feb. 5, 1998 still pending as of Sep. 16, 1999.

FIELD OF THE INVENTION

This invention relates to solenoid operated fuel injectors used to control the injection of fuel into an internal combustion engine.

BACKGROUND OF THE INVENTION

It is known in the art relating to fuel injectors to use hermetic laser welded joints rather than large space consuming O-rings to reduce the overall diameter of the injector. During the fabrication or assembly of such injectors, it is known to axially move the coil assembly on the fuel inlet tube to a position allowing the non-magnetic shell and fuel inlet tube to be welded together. After welding, the coil is displaced axially to cover the laser-welded joint.

Such construction does provide a reduced size fuel injector. However, a coil having a stepped or larger inside diameter is required to be axially displaced and fitted over the welded joint. A stepped coil eliminates space required for windings and is expensive. A coil having a larger inside diameter has less space available for windings.

Furthermore, such injectors typically require a short engagement length of the non-magnetic shell which is welded to the fuel tube, to allow some control of the injector length as the coil must be moved axially along the fuel tube. This short engagement length of the non-magnetic shell results in the working gap (the gap between the end of the fuel tube and armature) being outside the high flux area of the coil.

There is a need to further reduce the overall injector package size, especially the injector length, and to get the working gap into the high flux area of the coil.

SUMMARY OF THE INVENTION

The present invention provides a reduced size welded fuel injector having an increased engagement length of the non-magnetic shell to the fuel tube.

The present invention also provides a fuel injector having the working gap in the high flux area of the coil.

More specifically the solenoid actuated fuel injector includes an elongated ferromagnetic inlet tube having a major outside diameter portion and a reduced outside diameter portion and a step between the major and reduced outside diameter portions. A two-ended non-magnetic shell including an elongated tubular portion and a valve body shell engaging portion is fittable over the inlet tube reduced diameter portion and abuts the step in the inlet tube at one end.

A coil, for generating magnetic flux, is mountable around the elongated tubular portion of the non-magnetic shell and seated on the valve body shell engaging portion. The coil has a length shorter than the elongated tubular portion, at at least one circumferential point of the coil, allowing the inlet tube to be welded to the non-magnetic shell upon rotation relative to the coil without having to move the coil longitudinally.

In one embodiment, the coil includes a slot in an end disposed about the terminus of the non-magnetic shell elongated tubular portion to permit a laser welding beam to be directed at the terminus of the non-magnetic shell elongated tubular portion and inlet tube as the non-magnetic shell and inlet tube are welded.

The fuel injector also includes a valve body shell connected to the non-magnetic shell and forming a non-magnetic shell subassembly. A valve body, including an armature and valve means therein, is mountable in the valve body shell of the non-magnetic shell subassembly.

Preferably, the armature in these injectors is in spaced proximity to the terminus of the reduced outside diameter portion of the inlet tube and defines a working gap which is within the area defined by the coil.

A method of assembling a solenoid actuated fuel injector for use with an internal combustion engine comprises the steps of:

- disposing a coil over a non-magnetic shell having an end extending beyond a shortened portion of the coil;
- pressing an inlet tube into the non-magnetic shell with a shoulder of the inlet tube engaging said end of the shell;
- rotating the inlet tube and non-magnetic shell relative to the coil about a longitudinal axis; and
- simultaneously welding the inlet tube and non-magnetic shell at said end of the shell as it is exposed through said shortened portion of the coil during said rotating step.

In the preferred assembly, the non-magnetic shell is mounted on a valve body shell to form a non-magnetic shell subassembly.

These and other features and advantages of the invention will be more fully understood from the following detailed description of the invention taken together with the accompanying drawings.

DETAILED DESCRIPTION OF THE INVENTION

Figure 1:
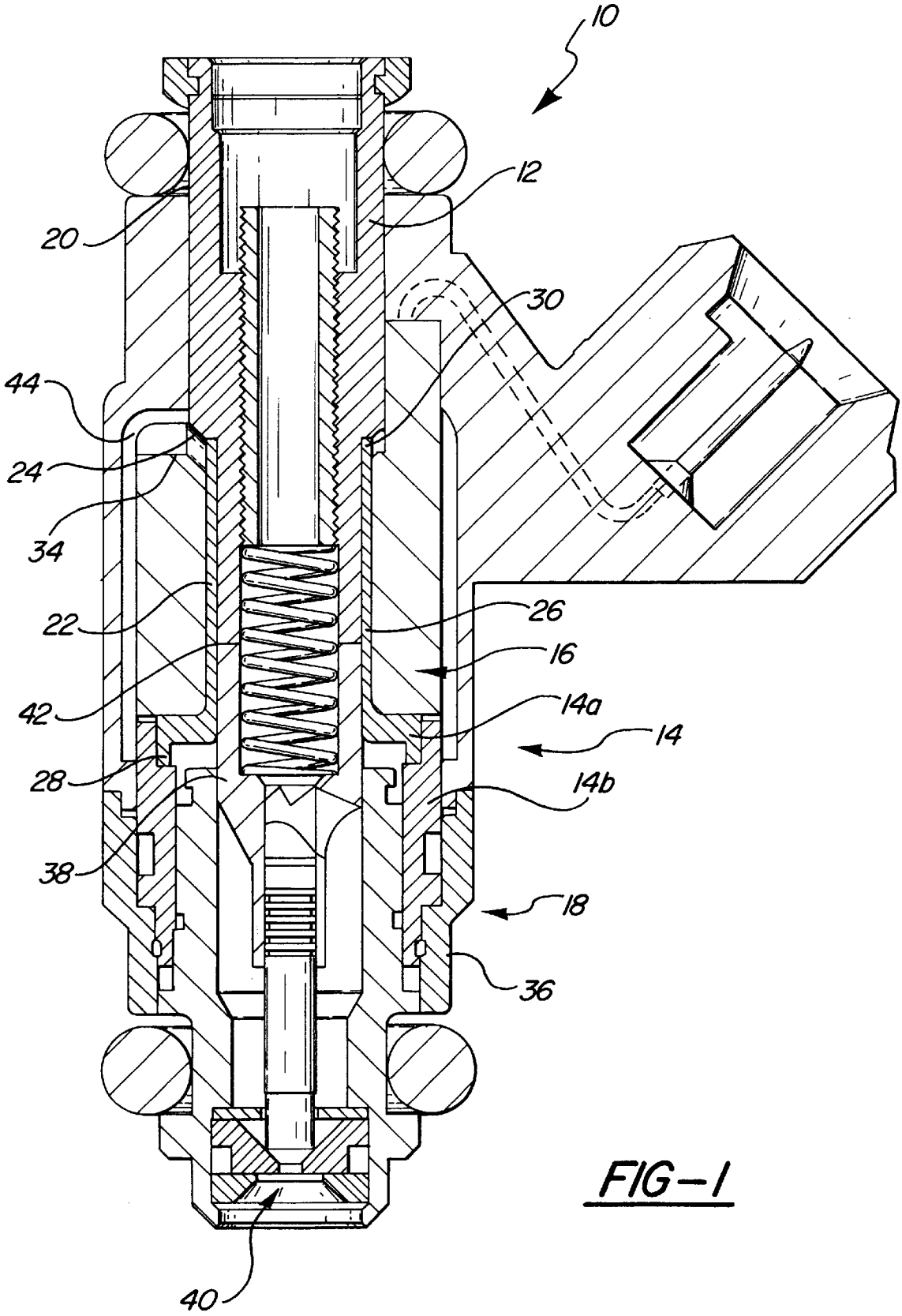
FIG. 1 is a longitudinal cross-sectional view of a fuel injector constructed in accordance with the present invention.

Referring now to the drawings in detail, numeral 10 generally indicates a fuel injector for use in an internal combustion engine. As is hereinafter more fully described, the working gap of the fuel injector is positioned toward the high flux area of the coil to obtain better injector performance. In addition, the non-magnetic shell is designed to be welded to the inlet tube without moving the coil in a longitudinal or vertical direction.

Figure 2:
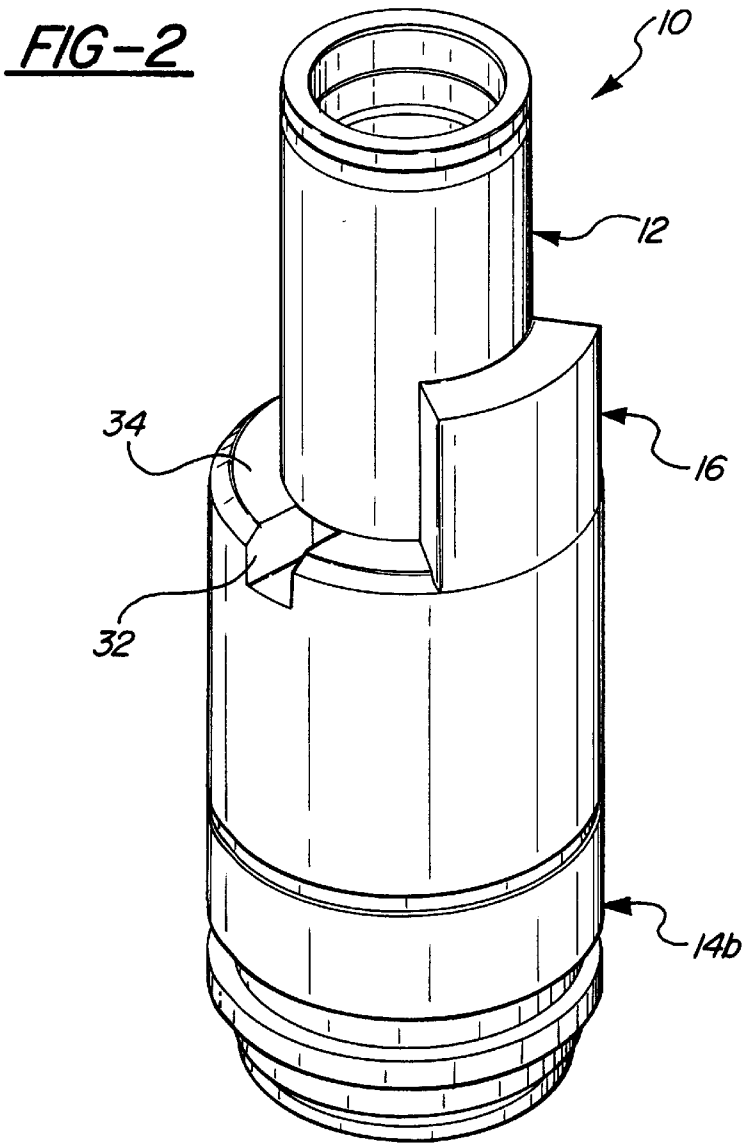
FIG. 2 is perspective view of a coil, tube and shell assembly of the fuel injector of the present invention.

FIGS. 1 and 2 illustrate the construction of injector 10. An elongated ferromagnetic inlet tube 12 for conducting pressurized fuel into the injector is hermetically welded, as hereinafter more fully described, to a non-magnetic shell subassembly 14 comprising a non-magnetic shell 14*a* and a valve body shell 14*b*. A coil 16, for generating magnetic flux to activate the fuel injector, is disposed over the weld and a valve body assembly 18 is connected to the valve body shell 14*b* of the non-magnetic shell subassembly 14.

With further reference to FIGS. 1 and 2, the elongated inlet tube 12 is ferromagnetic and has a major outside diameter portion 20 and a reduced outside diameter portion 22. Outside diameter portions 20 and 22 meet and define a step 24 therebetween. The non-magnetic shell subassembly 14 includes non-magnetic shell 14*a* having an integral elongated tubular portion 26 and a valve body shell engaging portion 28 to which the valve body shell 14*b* is welded. The elongated tubular portion 26 has an inside diameter fittable over the inlet tube 12 reduced diameter portion 22, assembling in telescopic fashion, and abuts the step 24 at one end on terminus 30.

The coil 16 is mountable around the elongated tubular portion 26 of the non-magnetic shell subassembly 14 with a loose tolerance such that it is allowed to rotate on the non-magnetic shell 14*a*. The coil 16 seats on the valve body shell engaging portion 28 of the non-magnetic shell subassembly 14. The coil 16 has a length shorter than the elongated tubular portion 26, at at least one circumferential point of the coil, allowing the inlet tube 12 to be welded to the non-magnetic shell 14*a* upon rotation relative to the coil without having to move the coil vertically or longitudinally along the axis of the injector.

Figure 3:
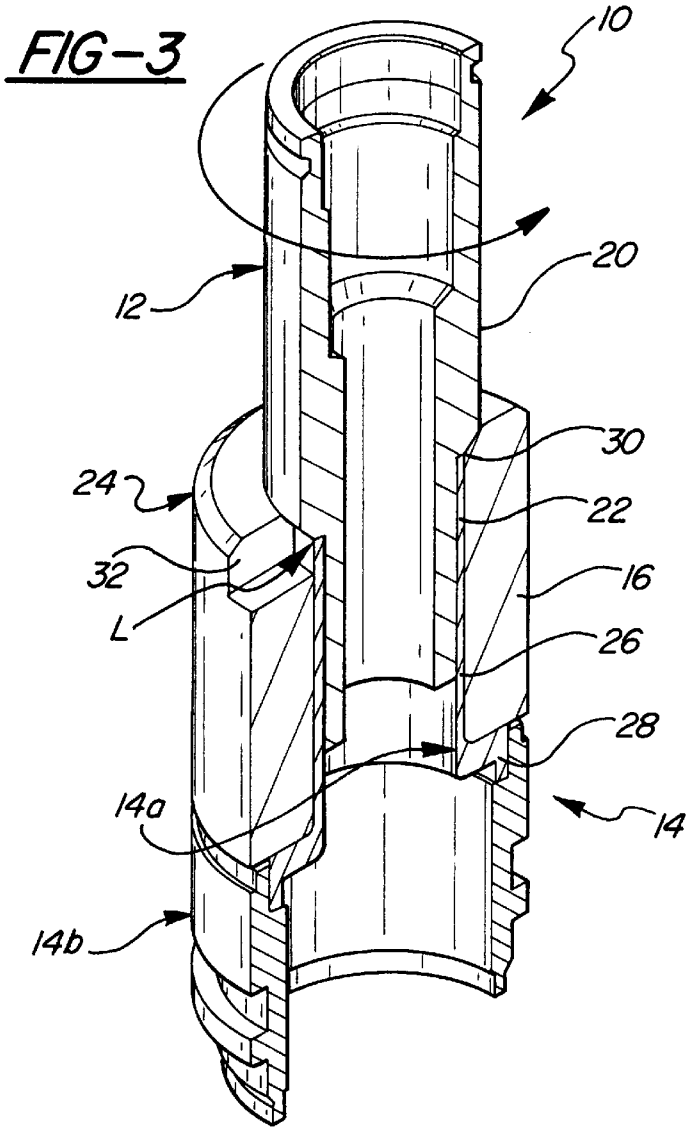
FIG. 3 is a longitudinal cross-sectional perspective view of the assembly of FIG. 2.

In the embodiment illustrated in FIGS. 2 and 3, the coil 16 includes a slot 32 in an end 34 disposed about the terminus of the non-magnetic shell 14 elongated tubular portion 26. The slot 32 permits a laser welding beam indicated at L to be directed at the terminus 30 of the elongated tubular portion 26 and inlet tube 12 as the inlet tube and shell are hermetically welded together.

With further reference to FIG. 1, a valve body 36, including an armature 38 and valve means 40 therein, is mountable via conventional means in the valve body shell portion of the non-magnetic shell subassembly 14. As can be seen, the armature is in spaced proximity to the terminus of the reduced outside diameter portion 22 of the inlet tube 12 and defines a working gap 42. The working gap 42 is within the area defined by the coil 16 in the high flux region of the coil. With the armature 38 and working gap 42 moved into the high flux region of the coil 14, the coil has increased performance without any increase in injector cost.

Figure 5:
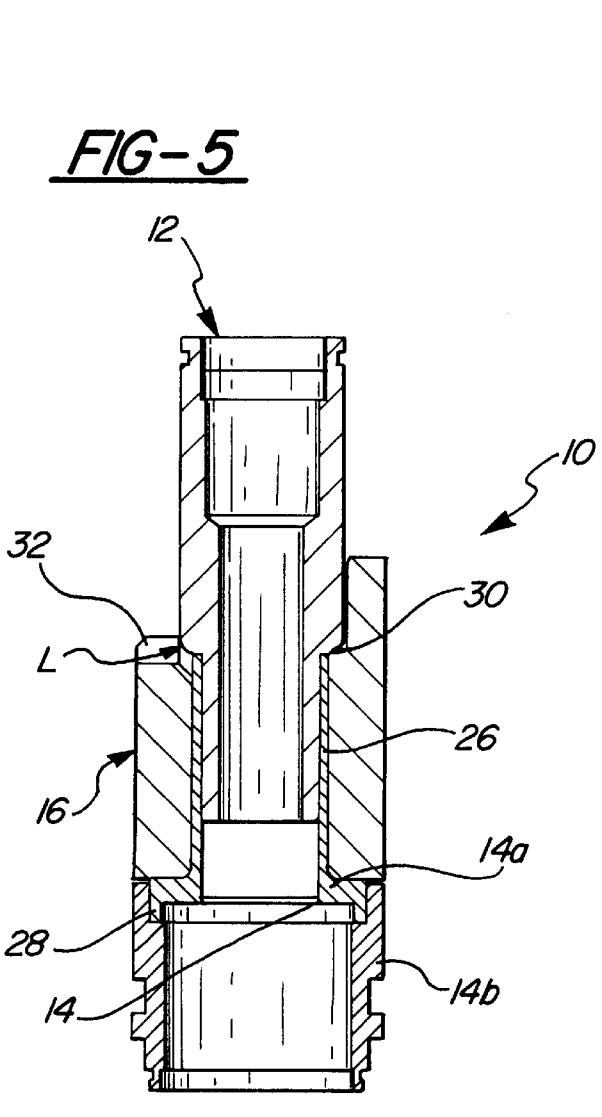
FIGS. 4–7 are respective longitudinal cross-sectional views illustrating a sequence of steps occurring during assembly of a fuel injector of FIG. 1.
Figure 4:
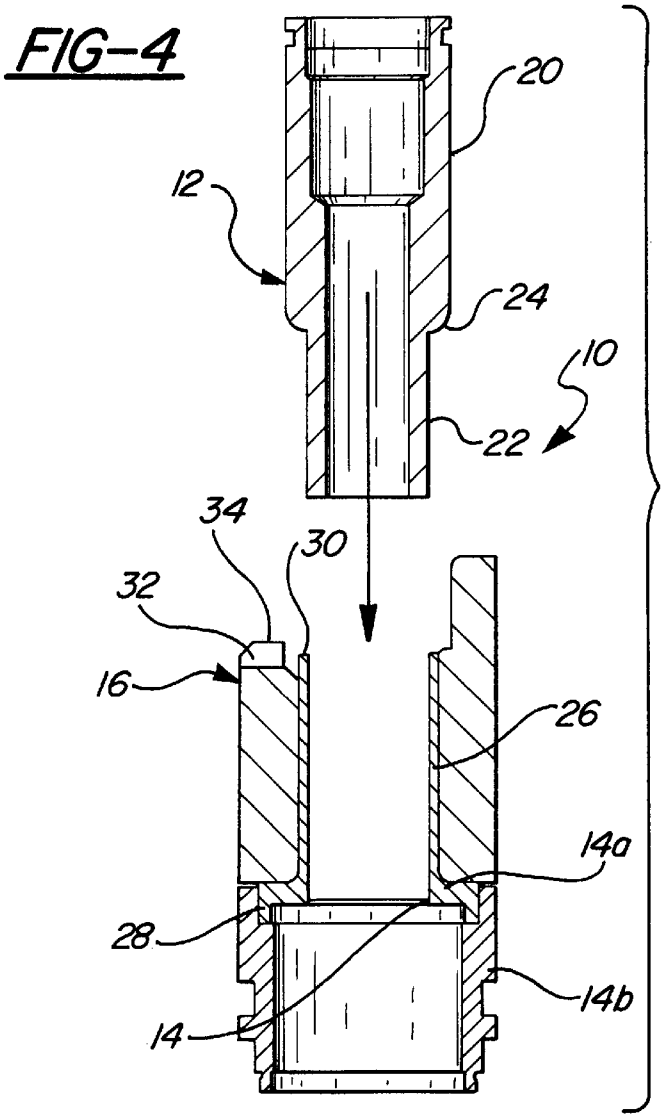

Referring to FIGS. 4–7 of the drawings, there is shown the sequence of steps occurring during fabrication of fuel injector 10. FIG. 4 illustrates the coil 14 disposed over the non-magnetic shell subassembly 14 and seated on the valve body shell engaging portion 28 of the non-magnetic shell subassembly. The inlet tube 12 is telescopingly fitted, by its reduced diameter portion 22, into the elongated tubular portion 26 of the non-magnetic shell until it abuts the step 24 in the inlet tube as shown in FIG. 5.

With continued reference to FIG. 5 and with reference to FIG. 3, the terminus 30 of the elongated tubular portion 26 of the non-magnetic shell subassembly 14 is welded by laser welding to the inlet tube 12, as the coil is held stationery and the inlet tube and non-magnetic shell are rotated during the weld operation. By not requiring the coil 16 to be moved along the longitudinal axis of the injector 10 during assembly, the working gap 42 of the injector can be placed in the high flux area of the coil as the engagement length of the non-magnetic shell 14 and inlet tube 12 are increased.

Figure 7:
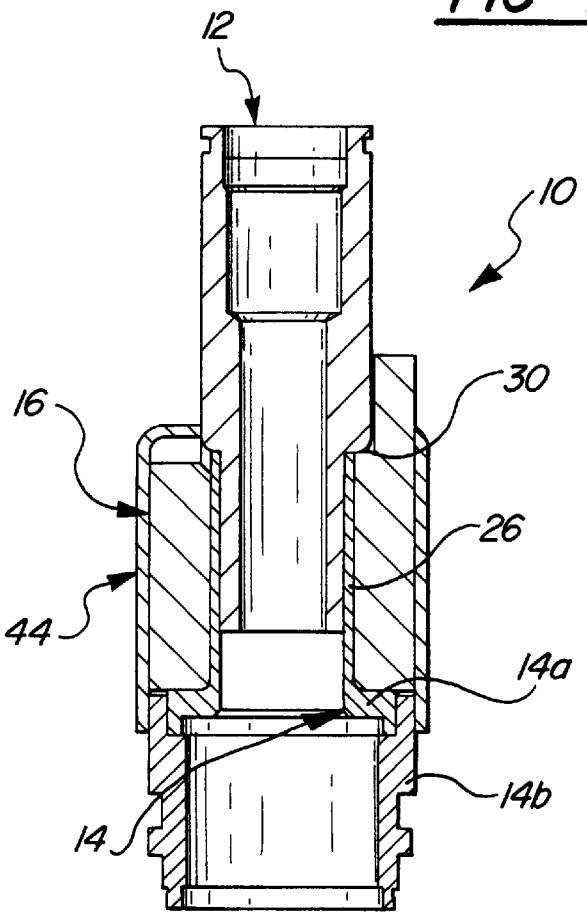
Figure 6:
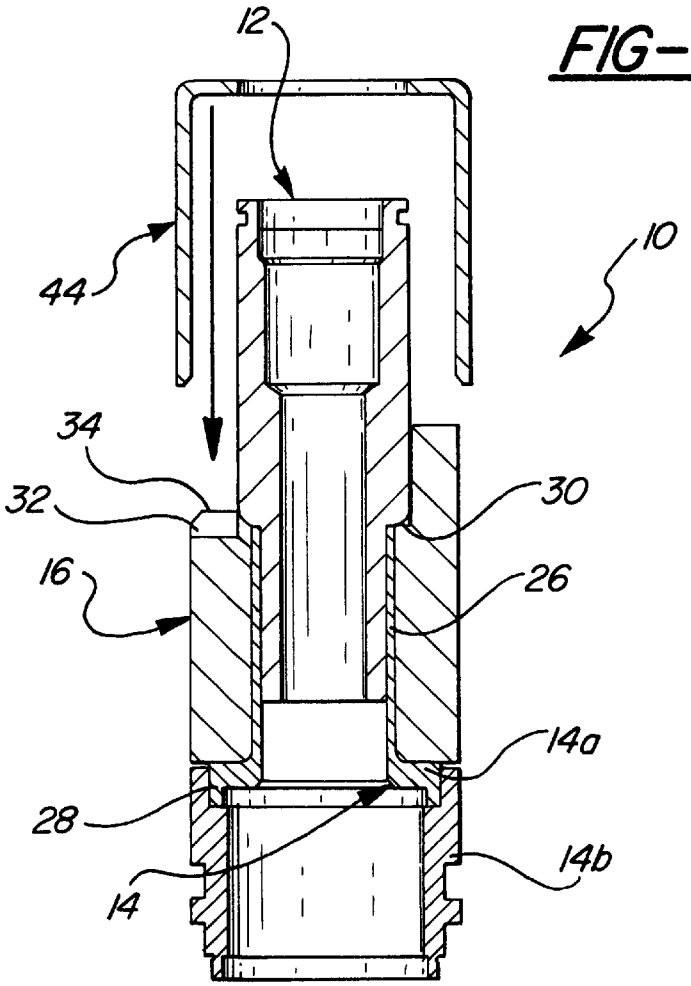

FIG. 6 illustrates the disposition of a housing 44 over a portion of the inlet tube 12 and coil 16. FIG. 7 illustrates the housing 42 in its assembled position on the injector 10.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A method of assembling a solenoid actuated fuel injector for use with an internal combustion engine, the method comprising the steps of:

disposing a coil over a non-magnetic shell having an end extending beyond a shortened portion of the coil;

pressing an inlet tube into said non-magnetic shell;

rotating said inlet tube and non-magnetic shell about a longitudinal axis; and simultaneously welding said inlet tube and non-magnetic shell at said end of the shell as it is exposed through said shortened portion of the coil during said rotating step.

2. The method of claim 1 comprising the step of:

pressing said non-magnetic shell onto a valve body shell to form a non-magnetic shell subassembly prior to disposing said coil over said non-magnetic shell.

3. The method of claim 2 comprising the step of:

mounting a valve body assembly in said valve body shell portion of said non-magnetic shell subassembly.

* * * * *